US010986862B2

(12) United States Patent
Milanes et al.

(10) Patent No.: US 10,986,862 B2
(45) Date of Patent: Apr. 27, 2021

(54) CIGARILLO AND METHOD OF MANUFACTURING SAME

(71) Applicant: JT International S.A., Geneva (CH)

(72) Inventors: Ernesto Milanes, Trier (DE); Ken Sumida, Tokyo (JP)

(73) Assignee: JT International S.A.

( * ) Notice: Subject to any disclaimer, the term of this patent is extended or adjusted under 35 U.S.C. 154(b) by 185 days.

(21) Appl. No.: 15/775,236

(22) PCT Filed: Nov. 28, 2016

(86) PCT No.: PCT/EP2016/079018
§ 371 (c)(1),
(2) Date: May 10, 2018

(87) PCT Pub. No.: WO2017/089611
PCT Pub. Date: Jun. 1, 2017

(65) Prior Publication Data

US 2018/0343916 A1 Dec. 6, 2018

(30) Foreign Application Priority Data

Nov. 27, 2015 (EP) ..... 15196760

(51) Int. Cl.
*A24D 1/02* (2006.01)
*A24B 3/14* (2006.01)
(Continued)

(52) U.S. Cl.
CPC ..... *A24D 1/02* (2013.01); *A24B 3/14* (2013.01); *A24C 1/26* (2013.01); *A24C 5/47* (2013.01); *A24D 1/00* (2013.01)

(58) Field of Classification Search
CPC .... A24D 1/00; A24D 1/02; A24B 3/14; A24C 1/26
See application file for complete search history.

(56) References Cited

U.S. PATENT DOCUMENTS 4,103,692 A 8/1978 Baler et al.
4,109,665 A * 8/1978 Godfrey, Jr. ..... A24B 3/14 131/358
(Continued)

FOREIGN PATENT DOCUMENTS

EP 2415363 A1 2/2012
WO 2007085967 A2 8/2007
WO 2014060455 A1 4/2014

OTHER PUBLICATIONS

International Search Report from PCT/EP2016/079018 dated Mar. 13, 2017, pp. 1-3.
(Continued)

*Primary Examiner* — Eric Yaary
*Assistant Examiner* — Jennifer A Kessie
(74) *Attorney, Agent, or Firm* — Lerner, David, Littenberg, Krumholz & Mentlik, LLP

(57) ABSTRACT

A cigarillo includes a tobacco rod element having tobacco cut filler and a binder layer which binds or holds the tobacco cut filler within the rod element; and an outer wrapper of natural tobacco leaf which encompasses or covers the tobacco rod element, wherein the natural tobacco leaf of the outer wrapper comprises a pattern imprinted or impressed therein. A method of producing a cover layer of natural tobacco leaf for use in manufacturing a cigarillo includes providing a substantially continuous web of a support material having a surface profile, which typically includes surface profile elements such as projections; arranging a plurality of natural tobacco leaves extended flat over the web of support material; and layering the substantially continuous web with the plurality of natural tobacco leaves supported thereon, whereby the surface profile of the web impresses or imprints a pattern into the plurality of natural tobacco leaves.

11 Claims, 3 Drawing Sheets

(51) Int. Cl.

| | |
|---|---|
| ***A24C 5/47*** | (2006.01) |
| ***A24C 1/26*** | (2006.01) |
| ***A24D 1/00*** | (2020.01) |

(56) References Cited

U.S. PATENT DOCUMENTS

| | | | | |
|---|---|---|---|---|
| 2006/0000481 | A1* | 1/2006 | Sinclair, Jr. ..... | A24D 1/02<br>131/347 |
| 2010/0154808 | A1* | 6/2010 | Boll ..... | A24D 1/00<br>131/58 |
| 2016/0143348 | A1* | 5/2016 | Camus ..... | A24D 3/048<br>131/329 |

OTHER PUBLICATIONS

Search Report for Application No. 15196760.1 dated Mar. 11, 2016, pp. 1-7.

* cited by examiner

CIGARILLO AND METHOD OF MANUFACTURING SAME

CROSS-REFERENCE TO RELATED APPLICATIONS

The present application is a national phase entry under 35 U.S.C. § 371 of International Application No. PCT/EP2016/079018, filed Nov. 28, 2016, published in English, which claims priority to European Application No. 15196760.1 filed Nov. 27, 2015, the disclosures of which are incorporated herein by reference.

BACKGROUND OF THE INVENTION

The present invention relates to a smoking article, especially a cigarillo, and to a method of manufacturing such a smoking article. In addition, the present invention provides a method of producing a wrapper or cover layer of natural tobacco leaf for use in manufacturing a smoking article, especially a cigarillo.

In the manufacture of smoking articles, such as cigars and cigarillos, the exterior of the smoking article is typically covered or wrapped with either natural tobacco leaf or reconstituted tobacco. Natural tobacco is considered to be of higher quality and better taste than reconstituted tobacco and therefore is generally considered to result in a higher quality product. Natural tobacco leaf is relatively expensive compared to reconstituted tobacco, however, and the handling of natural tobacco leaf requires more care and labour than the handling of reconstituted tobacco. In this regard, natural tobacco leaf is typically provided on a substrate and can tend to adhere or stick to the substrate, which in turn can make the handling difficult. Accordingly, the cost of manufacturing cigars and cigarillos having a cover layer or outer wrapper of natural tobacco leaf is typically significantly greater than the cost of manufacturing cigars and cigarillos having a cover layer or an outer wrapper of reconstituted tobacco.

In view of the above, therefore, it would clearly be useful and desirable to provide an improved smoking article, especially a cigar or cigarillo, which has an outer layer or wrapper of natural tobacco leaf, and yet which is simpler to manufacture and/or has a lower production cost.

SUMMARY OF THE INVENTION

In accordance with the invention, a smoking article, such as a cigarillo, having the features as recited in claim 1 is provided. Further, the invention provides a method of manufacturing a smoking article, especially a cigarillo, having the features as recited in claim 10. In addition, the invention provides a method of producing a cover layer or outer wrapper of natural tobacco leaf for use in manufacturing a cigarillo having the features as recited in claim 13. A number of advantageous or preferred features of the invention are recited in the dependent claims.

According to one aspect, therefore, the invention provides a smoking article, such as a cigarillo, comprising:

a tobacco rod element comprising tobacco cut filler and a binder layer which binds or holds the tobacco cut filler in the tobacco rod element; and a cover layer or outer wrapper of natural tobacco leaf which is wrapped around and covers or encompasses the tobacco rod element;

wherein the natural tobacco leaf of the cover layer or outer wrapper has a pattern which is imprinted or impressed therein.

In this regard, the pattern which is formed or impressed in the natural tobacco leaf of the cover layer or outer wrapper typically extends over a substantial area of the natural tobacco leaf, preferably over substantially the entire area of the tobacco leaf, and preferably comprises one or more raised portions and/or depressions formed in the surface of the natural tobacco leaf. In particular, the pattern may be substantially regular and may comprise a series or array of the raised portions and/or depressions. By providing the natural tobacco leaf of the outer wrapper with an imprinted or impressed pattern in this way, it has been surprisingly found that the natural tobacco leaf can be handled more easily and more reliably by the machinery used to assemble and produce the smoking articles. The easier and more reliable handling of the natural tobacco leaf therefore translates into greater production efficiency, less labour, and thus lower production costs.

In a preferred embodiment, the pattern is formed or impressed into a surface of the natural tobacco is arranged facing away from the tobacco rod element; that is, in an outwardly facing surface of the cover layer or outer wrapper.

In a preferred embodiment, the pattern comprises elongate and/or linear portions, especially elongate or linear raised portions and/or depressions. Such elongate or linear portions are desirably arranged to extend transverse to a longitudinal extent or a longitudinal axis of the smoking article. For example, the elongate or linear portions of the pattern in the natural tobacco leaf of the outer wrapper may extend at an oblique angle (preferably in a range of 30° to 90°, and more preferably in a range of 60° to 90°, or optionally generally perpendicular to a longitudinal axis of the smoking article, e.g. cigarillo. The substantially linear portions are therefore preferably in the form of ribs, and may be regularly spaced apart by an interval in the range of from about 0.5 mm to about 10 mm, more preferably in the range of about 1 mm to about 5 mm.

In a typical embodiment, the tobacco rod element of a cigarillo that is subsequently covered or wrapped with an outer layer or outer wrapper of natural tobacco leaf may be manufactured on standard, high-speed machinery used in the production of cigarettes with little or no changes. The binder layer or binder wrapper which binds or holds the tobacco cut filler within the tobacco rod element is preferably selected from the group consisting of: paper, homogenised tobacco material (e.g. cast tobacco or reconstituted tobacco), natural tobacco, and/or any combinations thereof. The paper may be white or alternatively it may be coloured to match a colour of the outer wrapper of the cigarillo. The paper is preferably non-porous or has a low porosity. The paper preferably has a low burn rate. The binder layer forms a cylindrical sheath or sleeve around the tobacco cut filler, as is known in the art, thereby creating the rod-like shape or form of the tobacco rod element.

In a preferred embodiment, the smoking article (e.g. cigarillo) further comprises a filter which is arranged adjacent to the tobacco rod element. The outer wrapper is wrapped around and encompasses or envelops at least part of the filter such that the outer wrapper physically and mechanically attaches or connects the filter to the tobacco rod element. Alternatively, or in addition, the filter may be attached to the tobacco rod element via tipping paper, e.g. a band or strip of tipping paper, which is wrapped around and encompasses or envelops at least part of the filter. In such a case, the cover layer or outer wrapper of natural tobacco leaf is applied after the tipping paper and thereby preferably covers and obscures the tipping paper. Accordingly, the tipping paper typically encompasses or circumscribes the filter and an adjacent portion of the tobacco rod element. Therefore, the region of the tobacco rod element encompassed or circumscribed by strip or band of the tipping paper is typically in the range of about 1 mm to about 16 mm in length, preferably in the range of about 2 mm to about 12 mm in length. As used herein, the term "length" denotes the dimension in the longitudinal direction of the smoking article.

The filter of each smoking article, especially a cigarillo, may comprise a single filter segment. Alternatively, a cigarillo according to this invention may include a multi-component filter comprising two or more filter segments. The one or more filter segments may comprise any suitable known filtration materials including, but not limited to, cellulose acetate, paper and combinations thereof. Preferably, the filter comprises at least one segment of a fibrous filtration material, typically a cellulosic filtration material, such as cellulose acetate tow. The filter will typically have a length in the range of about 5 mm to about 40 mm, and preferably in the range of about 15 mm to about 30 mm.

In a preferred embodiment, the cover layer or outer wrapper is wrapped around the tobacco rod element either cylindrically or helically. This cover layer or outer wrapper preferably comprises flue-cured Virginia tobacco leaf. The cigarillo according to the invention preferably has a length in the range of about 50 mm to about 130 mm and a diameter in the range of about 5.5 mm to about 10.5 mm.

According to another aspect, the invention provides a method of manufacturing a cigarillo, comprising the steps of:

fabricating a tobacco rod element comprising tobacco cut filler and a binder layer which binds or holds the tobacco cut filler within the tobacco rod element;

providing a cover layer of natural tobacco leaf, wherein the cover layer comprises a pattern imprinted or impressed into the natural tobacco leaf; and wrapping or encompassing the tobacco rod element with the wrapper layer of natural tobacco leaf.

In a preferred embodiment, the step of providing the cover layer of natural tobacco leaf comprises feeding or delivering the natural tobacco leaf to be wrapped around the tobacco rod element supported on a web of material. The web of material comprises a surface profile which impresses the pattern into the natural tobacco leaf.

In a particularly preferred embodiment of the invention, the web of material is a substantially continuous web and the surface profile of the web includes a plurality of surface profile elements which correspond to the pattern pressed into a surface of the natural tobacco leaf supported on the web. The web may, for example, comprise a woven material having a surface profile comprised of rows of linear surface profile elements configured to imprint or impress a corresponding pattern into the natural tobacco leaf of the cover layer. Thus, as noted above, the pattern is typically a regular pattern comprising elongate (e.g. linear) portions, especially raised portions or depressions, such as ribs, which are formed spaced apart over substantially the whole surface of the natural tobacco leaf. These elongate (e.g. linear) portions may extend generally transverse to a longitudinal axis of the cigarillo when the cover layer is wrapped around the tobacco rod element.

According to a further aspect, the invention provides a method of producing a cover layer or an outer wrapper of natural tobacco leaf for use in manufacturing a cigarillo, the method comprising:

providing a substantially continuous web of a support material having a surface profile, especially comprising a plurality of surface profile elements such as projections, which may be in a substantially regular array distributed over a surface thereof;

arranging a plurality of natural tobacco leaves extending flat over the web of support material in contact with the surface profile; and layering the substantially continuous web with the plurality of natural tobacco leaves supported thereon, whereby the surface profile of the web imprints or impresses a pattern into the plurality of natural tobacco leaves.

In a preferred embodiment, the step of layering the web with the plurality of natural tobacco leaves comprises rolling the web into a roll or bobbin. During the rolling, a tension of the web is preferably in a range which provides the roll or bobbin with a Shore A hardness in the range of about 50 to about 54; i.e. measured with a Shore meter.

In a preferred embodiment, the natural tobacco leaves supported on the web are arranged and held in a flat condition between layers of the web. Furthermore, the natural tobacco leaves are preferably arranged and/or held in a stretched condition between layers of the web.

In a preferred embodiment, the plurality of natural tobacco leaves are arranged on the web in spaced apart, generally parallel arrangement, and preferably extend substantially perpendicular to a longitudinal axis of the web.

The term "natural tobacco leaf" as used herein denotes a section of a tobacco leaf. For example, the natural tobacco leaf may be an elongate strip of tobacco leaf or a substantially rectangular portion of tobacco leaf. The cover layer or outer wrapper comprises at least one piece of natural tobacco leaf, but may comprise two or more pieces of natural tobacco leaf. The natural tobacco leaf may be cigarette tobacco like Virginia, Burley, Oriental and Semi-Oriental tobacco, although Virginia is particularly preferred. The natural tobacco leaf may be, for example air, sun, or flue-cured, although flue-cured is particularly preferred.

Cigarillos according to the invention may comprise any suitable tobacco cut filler. Preferably, the cigarillo comprises a cigarette tobacco cut filler comprising types of tobacco such as Virginia, Burley, Oriental and Semi Oriental. The tobacco cut filler may comprise a blend of two or more different types of tobacco. For example, the tobacco cut filler may comprise a blend of two or more of the above-mentioned different types of tobacco. Alternatively, the tobacco cut filler may comprise a single one of the above-mentioned types of tobacco. The tobacco cut filler may comprise tobaccos that are, for example, air, sun or flue-cured. Alternatively or in addition, the tobacco cut filler may have undergone treatment, for example, to reduce tobacco-specific nitrosamines (TSNA).

Besides tobacco leaf, the tobacco cut filler may comprise other ingredients typically found in tobacco cut filler such as, for example, expanded tobacco, homogenized tobacco (e.g. reconstituted tobacco, cast tobacco or extruded tobacco), tobacco stem (e.g. expanded or improved stem), tobacco fines, and any combinations thereof. Flavours and casings comprising one or more humectants, flavourants, sugars or combinations thereof may also be applied to the tobacco cut filler in a known manner.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

DETAILED DESCRIPTION

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

Figure 1:
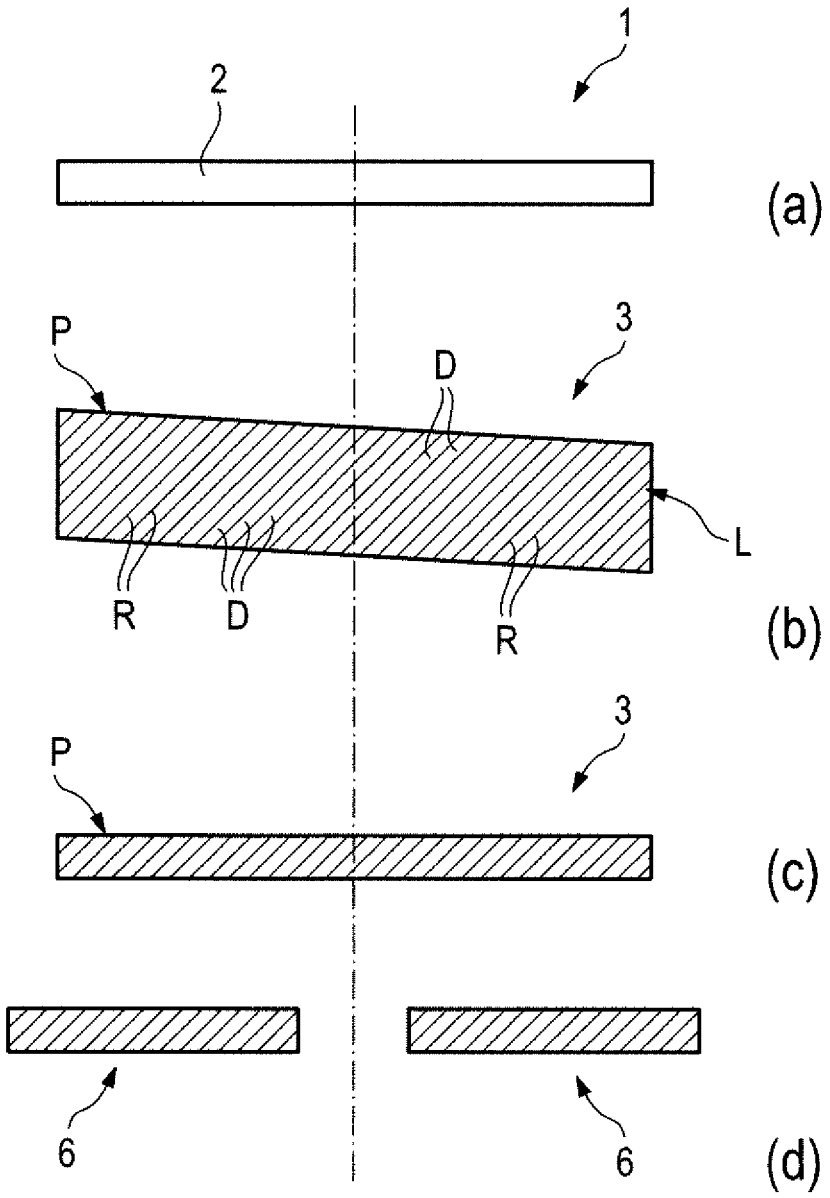
FIG. 1 is a schematic view of parts of a cigarillo as well as steps (a) to (d) in a method of manufacturing such a cigarillo according to an embodiment of the invention.

With reference to FIG. 1 of the drawings, parts and method steps in the production or manufacture a smoking article according to an embodiment of the invention are illustrated. In FIG. 1(*a*), a tobacco rod element 1 is shown, which is itself typically cut from a substantially longer tobacco rod (not shown) manufactured on known, high-speed machinery used in cigarette production. The tobacco rod element 1 comprises a filling of tobacco cut filler (not visible) which is covered or enclosed by a binder layer 2 that forms a generally cylindrical sheath or sleeve for holding the tobacco cut filler within the rod element 1. The binder layer 2 may, for example, comprise paper (e.g. cigarette paper) or homogenised tobacco material (e.g. cast tobacco or reconstituted tobacco). In FIG. 1(*b*), a cover layer 3 comprising natural tobacco leaf L is shown which forms an outer wrapper to be wrapped around the tobacco rod element 1. As is apparent from FIG. 1(*b*), the natural tobacco leaf L of the cover layer or outer wrapper 3 is formed with a pattern P of generally parallel linear raised portions or ribs R imprinted therein. The raised portions or ribs R are interspersed by depressions or dips D across substantially an entire surface area of the natural tobacco leaf L.

As seen in FIG. 1(*c*), the cover layer or outer wrapper 3 of natural tobacco leaf L is wrapped generally cylindrically around the tobacco rod element 1 such that the natural tobacco leaf L substantially entirely encompasses or envelops the tobacco rod element 1 and thereby forms an exterior of the smoking article thus produced. In this regard, the cover layer or outer wrapper 3 is arranged and wrapped with respect to the rod element 1 such that the linear raised portions or ribs R of the pattern P imprinted in the natural tobacco leaf L extend transverse to a longitudinal axis of the tobacco rod element 1. Finally, FIG. 1(*d*) illustrates that the tobacco rod element 1 wrapped with the cover layer 3 of natural tobacco leaf L may be cut, e.g. in the middle, to produce two cigarillos 6.

Figure 2:
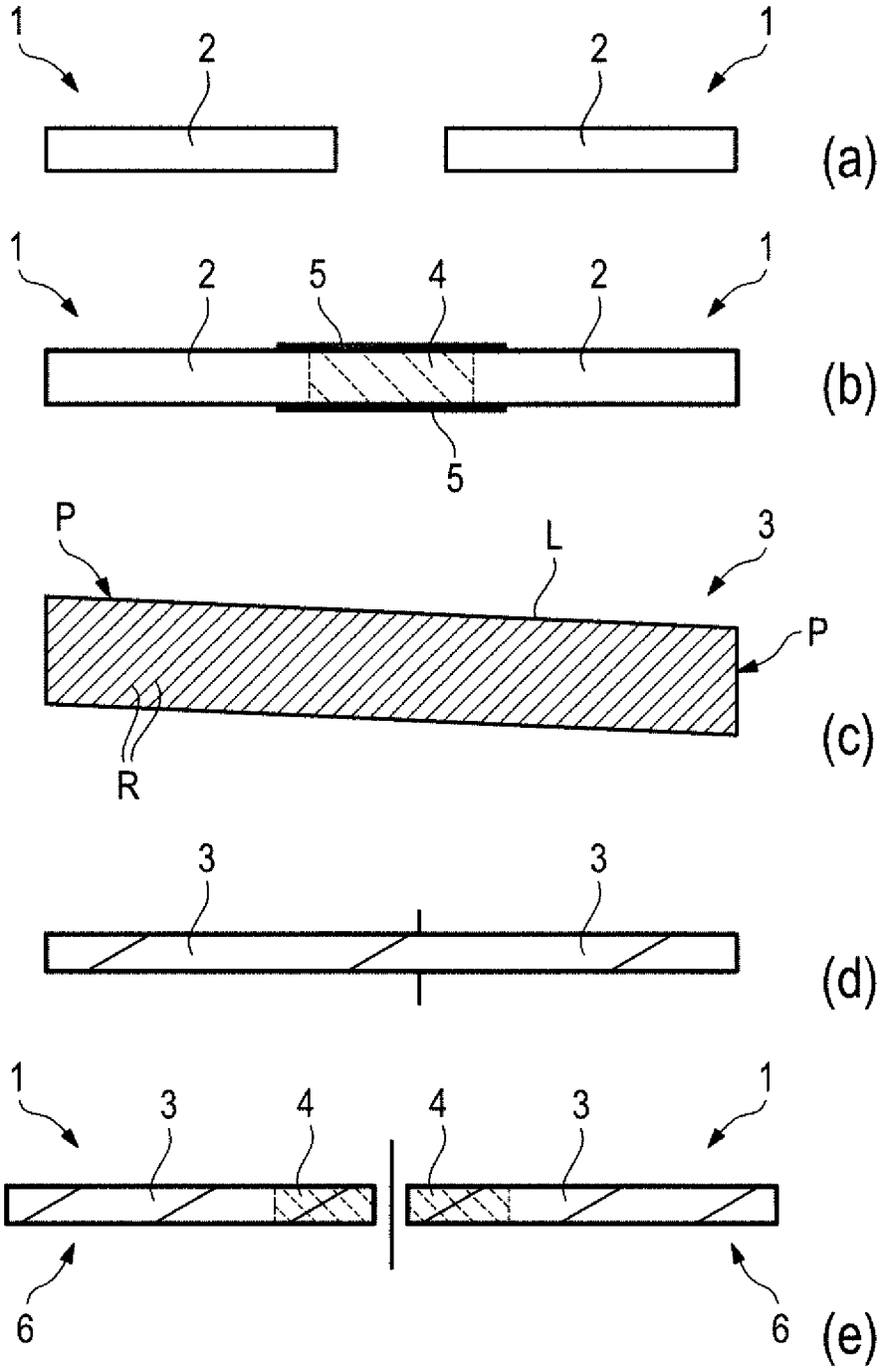
FIG. 2 is a schematic view of parts of a cigarillo as well as steps (a) to (e) in a method of manufacturing such a cigarillo according to another embodiment of the invention.

Referring now to FIG. 2 of the drawings, parts and method steps in the production or manufacture a cigarillo 6 according to another embodiment of the invention are illustrated. In FIG. 2(*a*), two shorter tobacco rod elements 1 are shown, which again are typically cut from a substantially longer tobacco rod (not shown) manufactured on known, high-speed machinery used in cigarette production. Again, each of the tobacco rod elements 1 comprises a filling of tobacco cut filler (not visible) which is covered or enclosed by a binder layer 2 that forms a generally cylindrical sheath or sleeve for holding the tobacco cut filler in the rod element 1. And again, the binder layer 2 may comprise paper or homogenised tobacco material. In FIG. 2(*b*), a filter element 4 is arranged between the two tobacco rod elements 1 and is attached to each of tobacco rod elements 1 by applying or wrapping a band or strip of tipping paper 5 around the filter element 4 and the adjacent end portions of the respective tobacco rod elements 1.

As seen in FIG. 2(*c*), a cover layer 3 comprising natural tobacco leaf L is provided which forms an outer wrapper to be wrapped around the tobacco rod element 1, as described above with reference to FIG. 1(*c*). Again, the natural tobacco leaf L of the cover layer or outer wrapper 3 is formed with a pattern P of generally parallel linear raised portions or ribs R imprinted therein. The raised portions or ribs R are interspersed by depressions or dips D across substantially an entire surface area of the natural tobacco leaf L. After the cover layer 3 is cylindrically wrapped around natural tobacco leaf L substantially entirely encompasses or envelops both of the tobacco rod elements 1, the tipping paper 5, and the filter element 4, and thereby forms the exterior of the smoking articles thus produced. Though not clearly shown in FIG. 2(*d*), the ribs R of the pattern P in the natural tobacco leaf L then extend transverse to a longitudinal axis of the tobacco rod elements 1, as before. Then, as seen in FIG. 2(*e*), the entity of the two tobacco rod elements 1 wrapped with the cover layer 3 of natural tobacco leaf L is cut in the middle of the filter element 4 to produce two cigarillos 6.

Figure 3:
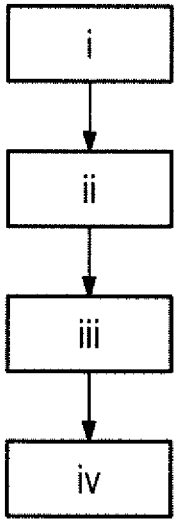
FIG. 3 is a flow chart representing a method of producing a cover layer of natural tobacco leaf for use in manufacturing a smoking article, such as a cigarillo, according to an embodiment of the invention.

Finally, with reference now to FIG. 3 of the drawings, a flow diagram is shown that schematically illustrates steps in a method of producing a cover layer or an outer wrapper of natural tobacco leaf for use in manufacturing a smoking article, such as a cigarillo, according to a preferred embodiment of the invention as described above with respect to FIG. 1 and FIG. 2. In this regard, the first box i of FIG. 3 represents the step of providing a substantially continuous web of a support material having a surface profile which comprises a plurality of surface profile elements, such as projections. The web may, for example, comprise a very long strip or sheet of woven material having a surface profile comprised of rows of linear surface profile elements. The second box ii represents a step of arranging a plurality of natural tobacco leaves L extended flat over the web of support material. In this regard, the natural tobacco leaves L are preferably arranged on the web in a spaced, generally parallel arrangement, and extend substantially perpendicular to a longitudinal axis of the web. The third box iii then represents the step of layering the substantially continuous web with the plurality of natural tobacco leaves L supported thereon. In this regard, the step of layering the web comprises rolling the elongate strip or sheet of the web material into a roll with the plurality of natural tobacco leaves supported on the web. The final box iv in FIG. 3 represents the step of the surface profile of the web impressing or imprinting a pattern P into the plurality of natural tobacco leaves L. This step may occur simultaneously with the layering step and/or may take place over an extended period of time during a step of storing the layered web material with the natural tobacco leaves L held or supported between the layers of web material, e.g. in a roll of the web material.

Although specific embodiments of the invention have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

In this document, the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 tobacco rod element
2 binder layer
3 outer wrapper or cover layer
4 filter element
5 tipping paper
6 cigarillo
L natural tobacco leaf
P imprinted pattern
R raised portion or rib
D depression or dip

The invention claimed is:

1. A smoking article, comprising:

a tobacco rod element comprising tobacco cut filler and a binder layer which holds the tobacco cut filler within the rod element; and an outer wrapper of natural tobacco leaf which encompasses or envelops the tobacco rod element;

wherein the natural tobacco leaf of the outer wrapper comprises a pattern having a series of raised or depressed elongate linear portions imprinted therein extending transverse to a longitudinal axis of the smoking article, and wherein the pattern extends substantially over an entire surface of the natural tobacco leaf.

2. The smoking article according to claim 1, wherein the series of raised or depressed elongate linear portions are formed at regularly spaced intervals over a surface of the natural tobacco leaf.

3. The smoking article according to claim 1, wherein the surface of the natural tobacco leaf on which the pattern is formed faces away from the tobacco cut filler.

4. The smoking article according to claim 2, wherein the intervals range from about 1 mm to about 10 mm.

5. The smoking article according to claim 1, wherein the binder layer is selected from the group consisting of: paper and homogenised or reconstituted tobacco material.

6. The smoking article according to claim 1, further comprising a filter arranged adjacent to the tobacco rod element, wherein the outer wrapper encompasses or covers at least a part of the filter to attach the filter to the tobacco rod element.

7. The smoking article according to claim 1, wherein the outer wrapper is wrapped cylindrically or helically around the tobacco rod element.

8. The smoking article according to claim 1, wherein the smoking article has a length of about 70 mm to about 100 mm and a diameter of about 7.5 mm to about 8.5 mm.

9. The smoking article according to claim 4, wherein the intervals range from about 2 mm to about 5 mm.

10. The smoking article according to claim 5, wherein the binder layer is paper, and wherein the paper is white or coloured to match a colour of the outer wrapper of the cigarillo.

11. The smoking article according to claim 7, wherein the outer wrapper comprises flue-cured Virginia tobacco leaf.

* * * * *